United States Patent [19]

Wilson

[11] 4,373,221

[45] Feb. 15, 1983

[54] BATHTUB SAFETY SUPPORT

[76] Inventor: Ruth I. Wilson, 1550 S. Baldwin, Lake Orion, Mich. 48035

[21] Appl. No.: 161,771

[22] Filed: Jun. 23, 1980

[51] Int. Cl.[3] ..... A47K 3/00; A47K 3/02; A47K 3/024; A47K 3/022

[52] U.S. Cl. ..... 4/559; 4/560; 4/571; 4/572; 4/573

[58] Field of Search ..... 4/560, 571, 572, 573, 4/575, 578, 579, 589, 590, 604, 611, 585–587, 621, 659; D6/86, 91; 248/441 B, 441 R, 297.3, 298, 221.3; 211/105.3

[56] References Cited

U.S. PATENT DOCUMENTS

| | | | |
|---|---|---|---|
| 937,476 | 10/1909 | Shipp | 4/572 |
| 2,177,998 | 10/1939 | Schuette | 4/572 |
| 2,222,070 | 11/1940 | Graves | 4/572 X |
| 2,237,177 | 4/1941 | Fischer | 4/572 |
| 2,243,974 | 5/1941 | Dunn | 4/576 |
| 2,438,979 | 4/1948 | Short | 4/573 X |
| 2,503,145 | 4/1950 | Zukor | 4/575 |
| 2,523,447 | 9/1950 | Reagan, Sr. et al. | 4/575 |
| 2,562,628 | 7/1951 | McPeake, Jr. | 4/572 X |
| 2,604,637 | 7/1952 | Moore | 4/575 |
| 2,815,513 | 12/1957 | Tilson et al. | 4/576 |
| 3,990,120 | 11/1976 | Rankin | 4/573 |

FOREIGN PATENT DOCUMENTS

| | | | |
|---|---|---|---|
| 696524 | 10/1964 | Canada | 4/575 |
| 447158 | 5/1936 | United Kingdom | 4/575 |

*Primary Examiner*—Henry K. Artis
*Attorney, Agent, or Firm*—Gifford, VanOphem, Sheridan & Sprinkle

[57] ABSTRACT

A safety support for supporting a body in an upright position while seated in a bathtub comprising a support bar having a curved central portion and secured transversely between the sides of the tub. The bar is supported by a pair of brackets secured to the side walls of the tub. The brackets include a plurality of registering apertures into which the ends of the bar can be inserted and permit the bar to be supported at different levels with respect to the floor of the tub. A retaining member confines the bather's body between itself and the support bar so that the body is retained in a substantially upright sitting position.

7 Claims, 10 Drawing Figures

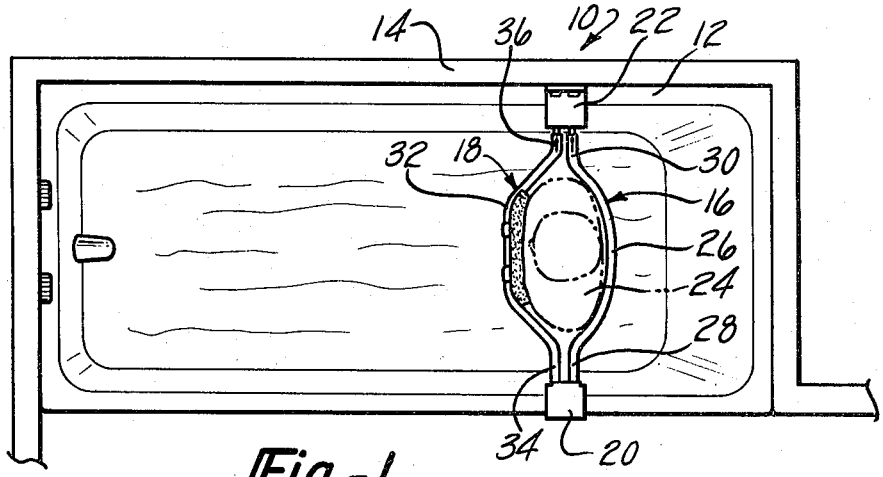
Fig-1
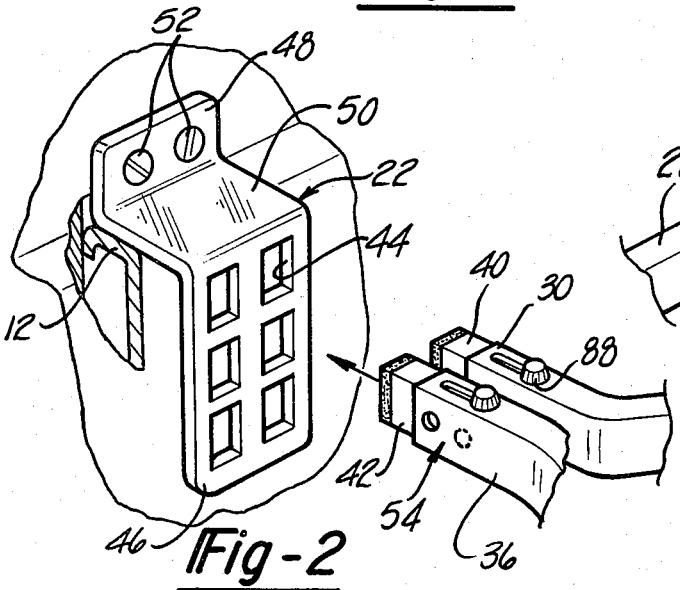
Fig-2
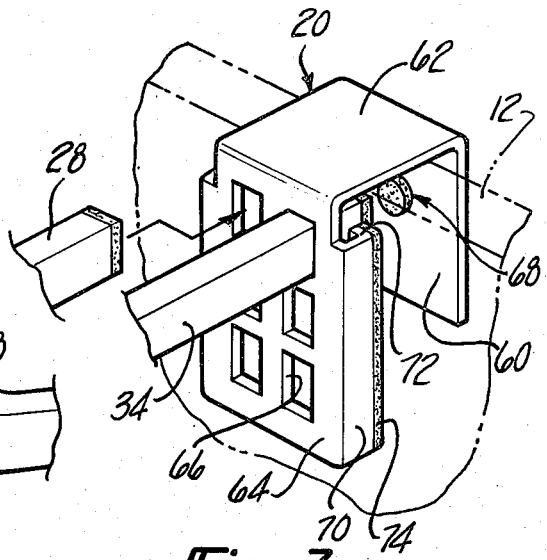
Fig-3
Fig-4
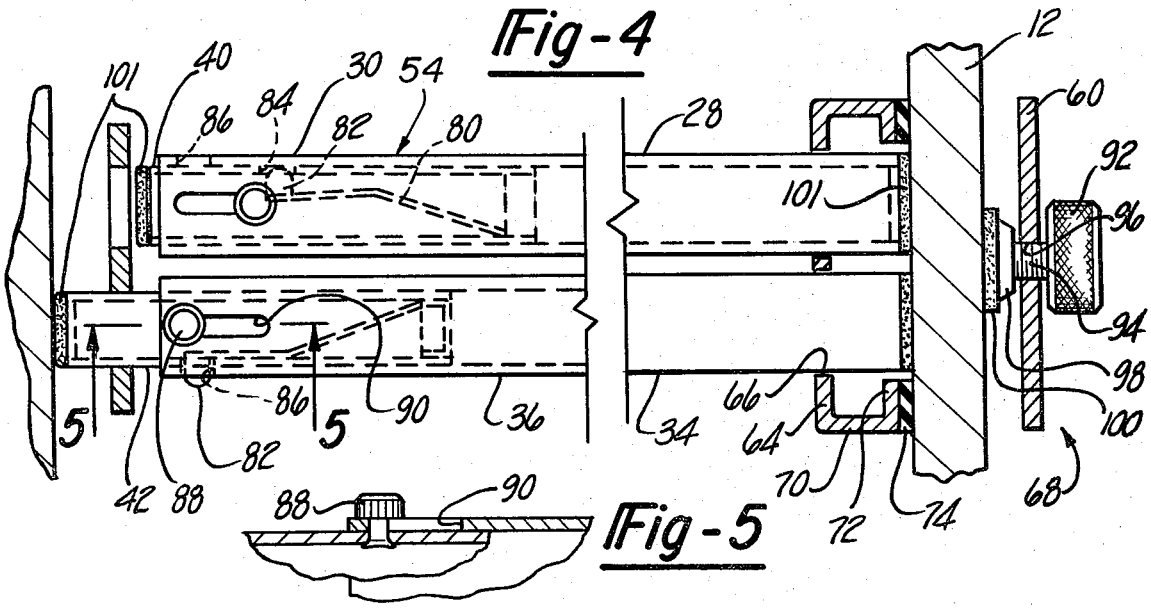
Fig-5

BATHTUB SAFETY SUPPORT

BACKGROUND OF THE INVENTION

1. Field of the Invention

The present invention relates generally to support devices for maintaining a person's body in an upright position and, more particularly, to such a support adapted to be secured to the side walls of the bathtub.

2. Description of the Prior Art

It is often difficult for physically handicapped persons or very young children to maintain an erect sitting position. Bathing in a water-filled tub, therefore, presents a great risk of danger to these individuals in that they can slip below the water level in the tub and are likely to drown if not closely attended by others. This is especially true of persons who are subject to unexpected spells of unconsciousness who may suddenly collapse without warning. Consequently, it would be advantageous to provide a body support for the safety of these individuals which would maintain their body in an upright position while sitting in a tub without a continuous conscious effort.

One previously known form of safety device for bathtubs comprises a safety rail surrounding the tub in order to provide a bather with an easily grasped support in order to provide leverage for entering or exiting the tub. Typically these rails are disposed above the water level of the tub and thus do not act to support a body which is submersed in the water-filled tub. Moreover, these rails do not operate to maintain a person's body in an upright position but merely provide a handle for leverage when entering or exiting the tub. It is necessary for the bather to make a conscious effort to grasp and lean against the rails. Although these rails can be provided with a seat 88 as shown in the U.S. patent to Tilson et al, U.S. Pat. No. 2,815,513, the seat only supports the body above the level of water in the tub. In addition the seat does not prevent the body from falling into the tub unless a conscious effort is maintained to remain on the seat.

Another form of support for a bather in a water-filled tub comprises a backrest which extends outwardly from the wall adjacent the rear of the tub and which is inclined rearwardly towards its top. Although the inclination of the backrest tends to avoid collapse of the body in the forward position, the backrest does not include body restraints which prevent the body from sliding down along the backrest or restrain the body from falling forward when a conscious effort is made to reach an object in the forward portion of the tub.

Another form of bathtub safety device disclosed in U.S. Pat. No. 3,990,120 comprises a body enclosing ring detachably and adjustably secured to a support rail mounted to a tub enclosing wall. The ring is made of two semicircular ring portions, each portion having radially extending arm portions 16 and 17 respectively. The arms are pivotally secured to the rail and include a locking screw for locking the ring in position with respect to the rail. Although each ring portion can be pivoted upwardly so that a body can enter within an extended ring portion before pivoting the upwardly pivoted ring downwardly so that the body is entrained between the two ring portions, the ring is not vertically adjustable so that persons of different size can use the ring while seated in the tub. In addition, the lateral placement of the rings is limited to the length of the rail. More particularly, the device is not well adapted for use by bathers who wish to be seated in the tub since the pivoting action of the rails requires that the diameter of the rings be large enough to be pivoted past the bather's shoulders which are substantially wider than the bather's chest. Consequently, the rings would only loosely enclose the body of the bather and would not prevent the bather from slipping below the rings. In addition, the ring does not abuttingly engage substantially the entire periphery of the body for maximum support.

SUMMARY OF THE PRESENT INVENTION

The present invention overcomes the above mentioned disadvantages and produces additional advantages by providing a bathtub safety support which stably supports a bather's body in an upright sitting position within the tub. The safety support comprises a support bar having a central curved portion and a pair of laterally extending end portions which are secured to opposite sides of the tub by a pair of brackets. The brackets are adjustable with respect to the sides of the tub and include means which permit vertical adjustment of the support bar with respect to the tub walls. The safety support also includes a restraining member which can be mounted in a fixed position with respect to the support bar whereby the body of the bather can be entrained between the retaining member and the support bar.

In one form of the invention, the retaining member is secured to the support bar adjacent the ends of the centrally curved portion. In an alternative form, the retaining member is substantially the same as the support bar and is secured at its ends to the brackets in a manner substantially the same as the support bar. In either cae, it is preferable to have a pliable, resilient member secured to the support bar along the surface of the curved central portion which engages the body of a bather. Such a member provides comfort to the bather and enables the size of the body engaging portion of the support to be varied to conform with the size of the bather.

The brackets include a depending plate which includes a plurality of vertically spaced apertures into which the straight ends of the support bar are slidably insertable. In one form of the invention, the width between the support brackets is fixed. In this case, at least one straight end of the support bar includes a telescopically extendable member. In its fully extended position, a locking pin of the telescoping member engages an aperture in the support bar so that the bar becomes locked in its elongated position. In its extended position, the telescoping member locks the support bar through registering apertures in the opposing brackets. When the telescoping member is in its retracted position, the support bar is displaceable between the brackets and can be easily repositioned to register with supporting apertures at a different level in the tub. In an alternate form of the invention, at least one bracket includes a laterally displaceable depending plate which is movable to vary the width between the brackets. Such a construction permits the support bar to be simply constructed of a single elongated member without a telescoping leg.

BRIEF DESCRIPTION OF THE DRAWING

The present invention will be more clearly understood by reference to the following detailed description of a preferred embodiment of the present invention when taken in conjunction with the accompanying drawing in which like reference characters refer to like parts throughout the several views, and in which:

FIG. 1 is a top plan view showing the bathtub safety support of the present invention secured to a tub;

FIG. 2 is a fragmentary exploded perspective view of one end portion of the safety support shown in FIG. 1;

FIG. 3 is a fragmentary exploded perspective view of the other end portion of the safety support shown in FIGS. 1 and 2;

FIG. 4 is a broken top sectional view of the safety support shown in FIG. 1;

FIG. 5 is a fragmentary sectional view taken substantially along line 5—5 in FIG. 4;

DETAILED DESCRIPTION OF A PREFERRED EMBODIMENT OF THE PRESENT INVENTION

Figure 6:
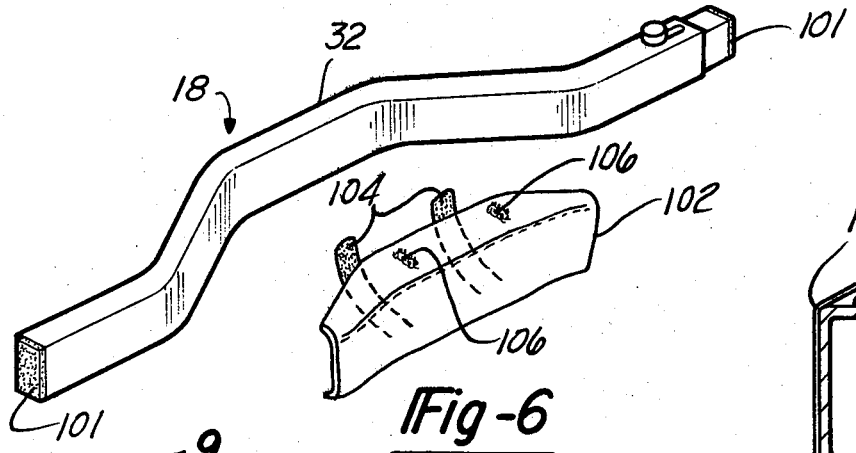
FIG. 6 is an exploded perspective view of the retaining member portion of the safety support shown in FIG. 1.

Referring now to FIG. 1, the safety support 10 is thereshown secured to a tub 12 and tub wall enclosure 14. The bathtub safety support 10 comprises a support bar 16 and a retaining bar 18 secured at opposite sides of the tub 14 by the brackets 20 and 22. The body 24 of a bather is confined between the support bar 16 and the retaining bar 18. As shown, the bar 16 includes a curved central portion 26 disposed between two laterally extending straight ends 28 and 30. Correspondingly, the retaining bar 18 includes a curved central portion 32 and laterally extending straight end portions 34 and 36.

As best shown in FIG. 2, the end portions 30 and 36 of the support bar 16 and retaining bar 18, respectively, are tubular and include telescopically received legs 40 and 42 respectively. Each leg 40 and 42 is slidably insertable into appropriately dimensioned apertures 44 in a depending plate 46 of the bracket 22. As illustrated in the drawing, the apertures 44 and the cross sections of the legs 40 and 42 and end portions 28 and 34 (FIG. 3) are square. Such a structure eliminates rotation of the bars about their axes. Such a feature is especially important when only a single bar extends across the tub as is shown in the drawing in FIGS. 8–10 to be described hereinafter, since it maintains substantially upright positioning of the bather's upper body.

As shown in FIG. 2, the wall bracket 22 comprises a wall engaging flange 48, a tub engaging portion 50 and the depending plate 46. The wall engaging flange 48 is secured to the wall 14 by means of bolts 52 or the like while the tub engaging portion 50 rests on the upper portion of the tub wall 12. The plate 46 extends downwardly adjacent the inner surface of the wall 12. Although as shown in FIG. 2, the plate 46 is spaced slightly from the inner surface of the wall 12 to provide additional tolerance for the extension of the legs 40 and 42, it is to be understood that the plate 46 could be flush against the inner surface of the wall 12 provided that the thickness of the plate 46 is sufficient to permit the apertures 44 to define a socket which sufficiently engages the end portions of the support bar 16 and the retaining bar 18. One manner of increasing the thickness of the plate is disclosed in the description of plate 20 below. The locking means generally shown at 54 will be discussed in greater detail hereinafter with respect to FIG. 4.

Referring now to FIG. 3, the opposing bracket member 20 is thereshown comprising a depending flange 60, a laterally extending wall engaging portion 62 and a depending plate portion 64. The plate 64 includes a plurality of apertures 66 which are similar to the apertures 44 in the plate 46 of bracket 22 and are appropriately dimensioned to slidably receive the ends 28 and 34 of the bars 16 and 18 respectively. As shown, the apertures 66 are aligned in a pair of vertical rows so that the bars 16 and 18 can be aligned at the same level. As shown, the plate 64 includes side walls 70 and rear flanges 72 which engage the inner surface of the tub wall 12. Preferably, each rear flange 72 is covered with a pliable resilient material such as the rubber pad 74. The depending flange 60 includes locking means 68 so that the bracket 20 can be locked against the side of the tub 12 such that the apertures 66 register with the apertures 46 in the plate 22.

Although only one bracket 20 is shown in FIG. 1, it is to be understood that a bracket 20 could be substituted for the bracket 22 where the tub wall 12 is not abutted by an enclosure wall 14. In such a case, the position of the safety support 10 can be adjusted along the entire length of the tub.

Referring now to FIG. 4, the locking means 54 and 68 can be described in more detail. The leg 40 is shown in its fully retracted position within the end portion 30 of bar 16 whereas the leg portion 42 is shown in its fully extracted position with respect to the end portion 36 of the retaining member 18. Nevertheless, the locking means 54 for each of these members is substantially the same, as shown, and comprises a spring member 80 which urges a locking pin 82 outwardly through an aperture 84 in the legs 40 and 42. When the leg is in its retracted position, such as the leg 40 of member 16 is shown in FIG. 4, the pin 82 rests against the inner surface of the tubular end 30. When the leg is fully extended, such as the leg 42 of member 18 is shown in FIG. 4, the aperture 84 registers with an aperture 86 in the end 30 or 36 whereby the pin 82 is engaged within the apertures 84 and 86 and locks the leg into position with respect to the ends 30 or 36 of the bars 16 and 18.

Each leg 40 and 42 includes a stemmed knob 88 extending laterally outward from the leg. The stem registers with and is slidably received in elongated slot 90 in the bar end 30 or 36 and the enlarged head of the knob extends above the outer surface of the bar (FIG. 5) to enable the legs to be easily extended and retracted from the ends of the bars.

Still referring to FIG. 4, the locking means 68 is thereshown secured to the depending flange 66 of bracket 20. The locking means comprises a threaded fastener having an enlarged head 92 and a threaded stem 94. The threaded stem 94 engages a correspondingly threaded aperture 96 in the flange 60. An abutment cap 98 having a resilient pad 100 is secured to the other end of the threaded stem 94 whereby rotation of the nut 92 displaces the abutment cap 98 and pad 100 to adjust the frictional engagement of the pads 100 and 74 against the sides of the tub wall 12.

Figure 7:
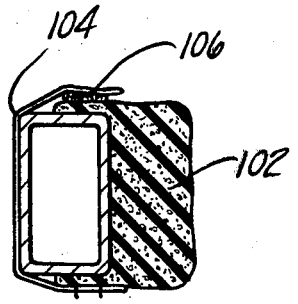
FIG. 7 is a sectional view taken substantially along the line 7—7 in FIG. 1.

Referring now to FIG. 6, the safety support of the present invention preferably includes a detachable cushion 102 which is secured to the support bar 16 and the retaining bar 18 at their curved portions 26 and 32, respectively, to face the bather's body. As best shown in FIG. 7, the cushion 102 is preferably made of sponge rubber and includes a strap 104 which extends around the bars 16, 18 and fastens to the sponge rubber pad by means of velcro fasteners 106 or the like. It can be seen that by varying the thickness of the cushion 102, the size of the opening defined by the arcuate portions 26 and 32 can be adjusted to fit a wide variety of body sizes.

Preferably, all parts which contact or abut against the tub walls include soft resilient pads to prevent destruction or marring of the tub walls. Consequently, the ends of the legs 40 and 42 and ends 28 and 34 include rubber pads 101, and both brackets 20 and 22 include pads such as the pads 74 or 100.

Figure 8:
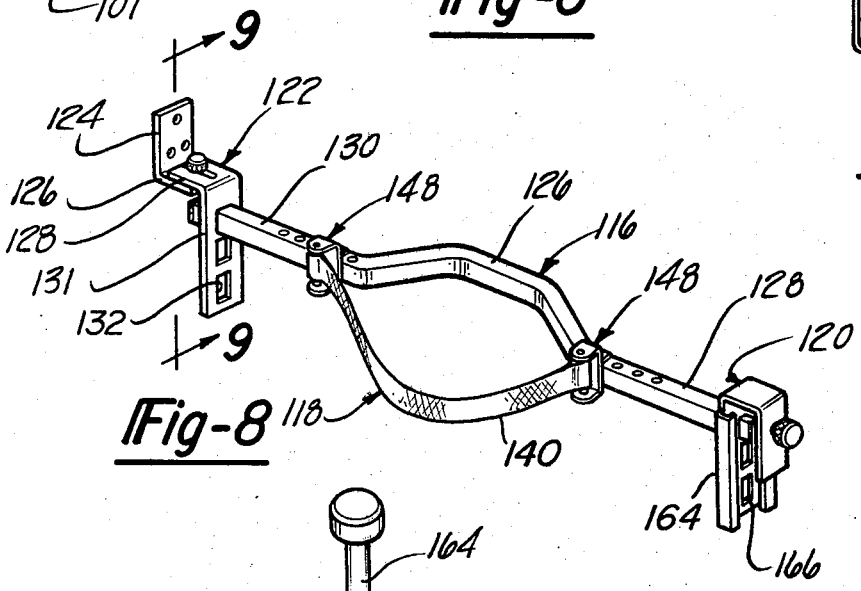
FIG. 8 is a perspective view of a safety support similar to the device shown in FIG. 1 but showing a modification thereof.
Figure 9:
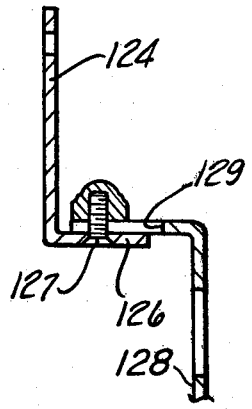
FIG. 9 is a sectional view taken substantially along the line 9—9 in FIG. 8.
Figure 10:
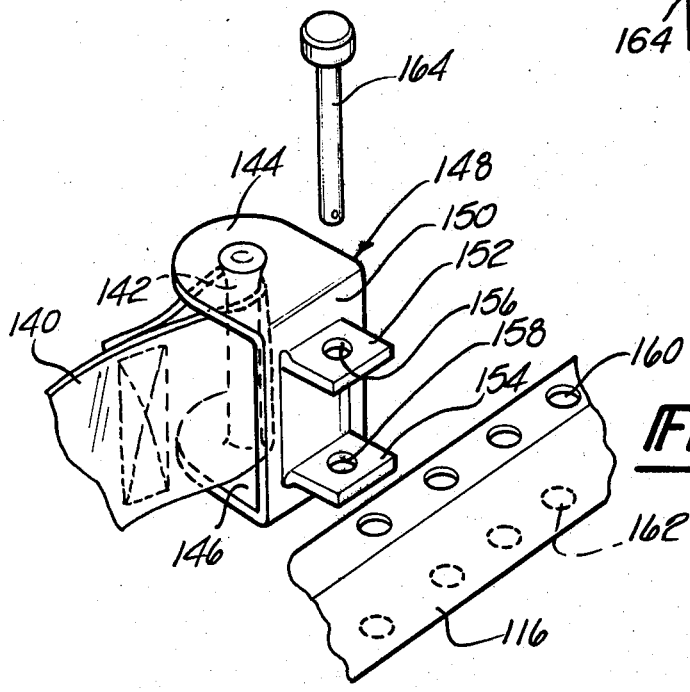
FIG. 10 is an exploded perspective view of a portion of a device shown in FIG. 8.

FIGS. 8 through 10 disclose a modification of the device shown in FIGS. 1 through 7. As shown in FIG. 8, the safety support comprises a single support bar 116 extending across the tub and mounted to the tub walls by means of the brackets 120 and 122. The retaining member 118 is secured to the support bar 116 adjacent the ends of the curved central portion 126 of the support bar 116. Although the bar 116 could be substantially the same as the support bar 16 provided that means are included on the bar for mounting the retaining member 118 thereto, as shown in FIG. 8 the bar 116 includes solid end portions 128 and 130 which do not incorporate a locking means such as the means 54. Rather the attachment and detachment of the bar 116 to the brackets 120 and 122 is facilitated by the construction of the bracket 122.

The bracket 122 comprises two substantially L-shaped members. The first L-shaped member includes a wall engaging flange 124 and a tub engaging flange 126. The second L-shaped member includes a first flange 128 and a second depending flange 131 having several apertures 132 aligned in a vertical row. As best shown in FIG. 9, the flange 126 includes an aperture adapted to receive a threaded fastener 127 therethrough. The flange 128 includes an elongated slot 129 adapted to slidably receive the threaded fastener therethrough. An enlarged nut engages the free end of the fastener to secure the flange 128 to the flange 126. When the nut is loosened, the second L-shaped member can be slid apart from the first L-shaped member and detached therefrom. The bar 116 is inserted through one of the apertures 132 at an appropriate level and the second L-shaped member is then easily secured to the first L-shaped member which is secured to the wall through the flange 124. On the other hand, the bracket 120 is substantially the same as the bracket 20 except for the fact that only a single vertical row of apertures 166 are provided in the depending flange 164.

The essential feature of the safety support shown in FIG. 8 is that the retaining member 118 is secured to the support bar 116. The retaining member 118 comprises a strap 140 having looped ends. As best shown in FIG. 10, a pin 142 extends through the loop in each end of the srap 140. The pin 142 is secured at each end between flanges 144 and 146 of a bracket member 148. The flanges 144 and 146 face each other and extend outwardly from the ends of a bracket wall 150. The bracket wall 150 includes a pair of parallel flanges 152 and 154 which have been punched out from the wall 150. An aperture 156 in the flange 152 registers with an aperture 158 in the flange 154. The flanges 152 and 154 are appropriately spaced apart so as to engage opposite surfaces of the support bar 116. The upper and lower surfaces of the bar 116 include registering apertures 160 and 162 respectively. The bracket 148 is slid into position on the bar 116 such that the flange 152 engages the upper surface of the bar 116 and the flange 154 abuts against the lower surface of the bar 116. The apertures 156 and 158 are then aligned with a pair of apertures 160 and 162 and a pin 164 is inserted therethrough to secure the bracket 148 to the bar 116.

A plurality of registering apertures 160 and 162 are longitudinally spaced along the bar 116 so that the position of the bracket 148 is adjustable with respect to the curved portion 126 of the bar 116. By adjusting the position of the brackets 148, the area enclosed between the restraining member 118 and the support bar 116 can be adjusted to fit various body sizes.

Having thus described the important structural features of the safety support of the present invention, the operation of the safety support can be easily understood. In the example shown in FIGS. 1 through 7, a bracket 22 is secured to the wall 14 at an appropriate position along the wall of the tub in a position where a person wishes to be seated in the tub. The bracket 20 is then slid over the side wall 12 of the tub so that the plate 64 extends downwardly along the inner surface of the tub wall 12. The knob 92 is then rotated to urge the pads 74 and 100 into tight contact against the sides of the tub wall 12 to lock the bracket in position.

The end 28 of the support bar 16 is then inserted into one of the apertures 74 in the plate 64 at a height which is comfortable to the bather. The end 30 having the leg 40 in a fully retracted position is then aligned with the aperture 44 which registers with the aperture 66 into which the end 28 has been inserted. When the end 30 is appropriately aligned, the button 88 is then slid toward the outer end of the slot 90 so that the leg 40 is urged into the aperture 44. When the leg 40 has been fully extended, the aperture 84 is aligned with the aperture 86 and the lock pin 82 is then urged by the spring member 80 to extend outwardly from the bar end 30 so that the leg 40 is locked in its extended position. The bather can then be seated in the tub against the support bar 16.

The end 34 of the retaining bar 18 is then inserted into the hole 66 adjacent the hole 66 in which end 28 of bar 16 is inserted. The end 36 of the bar is then aligned with the registering aperture 44 in the plate 22 and the leg 42 extended into the aperture 44 in the manner previously discussed. The bather's body is then confined between the support bar 16 and the retaining bar 18 so that no conscious effort is necessary in order to maintain the person in an upright sitting position while in the tub.

After bathing, the person merely depresses the locking pin 82 against the pressure of the spring 80 and slides the knob 88 towards himself to thereby retract the leg 42 within the bar 18 and thus disengage it from the aperture 44. The end 34 of the bar 18 can then be slid from the aperture 66 in which it was engaged, thereby freeing the bather for exit from the tub.

The modified device shown in FIGS. 8 through 10 operates in a similar manner in that the flange 124 is secured to the wall 14 in substantially the same manner that the flange 48 of bracket 22 is secured to the wall 14. The bracket 120 is secured in position on the tub wall in substantially the same manner as previously described for the bracket 20. In addition, the end 128 of the bar 116 is inserted into one of the apertures 166. However, the end 130 of the bar 116 is inserted into a corresponding aperture 132 in the plate 131 while that bracket portion is detached from the mounted bracket portion. The plate 131 is freely slidable along the end portion 130 of the bar 116 and is then slid outwardly toward the end of the bar 116 until the flange 128 rests upon the flange 126 of the first L-shaped member in such a manner that the threaded fastener 127 is engaged within the slot 129 of the flange 128 and the nut can then be tightened to secure the second L-shaped member to the first L-shaped member and thus securely mount the support bar 116 across the tub.

The bather then sits in the tub and rests against the bar 116. The brackets 148 are then slid onto the ends 128 and 130 of the bar 116 and aligned so that the apertures 152 and 154 are aligned with the apertures 160 and 162 in the bar 116. The pin 164 is easily inserted through the registering apertures to lock the bracket 148 in place. The band 140 is then extended across the front of the bather's body to provide a minimum of tolerance of movement of the bather's body away from the bar 116. The apertures 156 and 158 of bracket 148 are aligned with an appropriate pair of apertures 160 and 162 in the bar 116 and a second pin 164 is inserted therethrough to maintain the strap 140 in that position.

When the bather has finished, a single pin 164 is easily removed from one of the brackets 148 so that the person is no longer restrained against moving away from the bar 116 and can freely exit from the tub.

Preferably each bar 16 and 18 or the single bar 116 is provided with a cushioning pad 102 of an appropriate size for the particular bather to reduce physical discomfort of retaining the bather's body between the support bar and the retaining member.

Thus, the present invention provides a safety support for supporting the body in an upright sitting position in a bathtub. The device is easily attached to and detached from the sides of the tub but which remains rigidly supported within the tub to prevent a body from collapsing below the level of water in the tub. Moreover, the device is easily adjustable to accommodate a wide variety of body sizes. In addition, the device can be adjusted along the length of the tub and the height of the device above the floor of the tub is easily adjustable.

Having thus described my invention, many modifications thereto will become apparent to those skilled in the art to which it pertains without departing from the scope or spirit of the present invention as defined in the appended claims.

What is claimed is:

1. An apparatus for holding a person's body in a substantially upright sitting position while bathing in a tub comprising:

a support bar having a curved central portion intermediate two straight end portions;

first selectively engageable means for supporting said end portions between opposing side walls of the tub at one of at least a plurality of predetermined heights and horizontal positions; and second means for limiting displacement of a person's body away from said curved central portion; wherein said first means comprises at least one bracket having means for securing said bracket to a side wall of said tub, and bracket means for slidably receiving at least a portion of each of said two straight end portions at any of said plurality of predetermined heights.

2. The invention as defined in claim 1 and further comprising third means for resisting rotation of said support bar about the axes of its straight end portions, whereby when said first means is operative, said bar remains stationary.

3. The invention as defined in claim 1 and further comprising third cushioning means for resiliently engaging the bather intermediate said curved central portion and the bather's body.

4. The invention as defined in claim 1 wherein said second means comprises a strap and means for mounting said strap to said support bar, whereby each end of said strap is secured to said support bar, such that the maximum area enclosed between said strap and said support bar is limited.

5. The invention as defined in claim 4 and further comprising means for adjusting the maximum area enclosed between said strap and said support bar.

6. The invention as defined in claim 1 wherein said second means comprises a second support bar having a curved central portion, and selectively engageable means for supporting said end portions between opposing side walls of the tub.

7. The invention as defined in claim 1 wherein said support bar is tubular and said first means includes at least one second bar telescopically received in at least one straight end of said first support bar, means for adjusting the position of said second bar with respect to said first bar between retracted and extended positions, and means for locking said at least one second bar in its extended postion.

* * * * *

UNITED STATES PATENT AND TRADEMARK OFFICE

CERTIFICATE OF CORRECTION

PATENT NO. : 4,373,221

DATED : February 15, 1983

INVENTOR(S) : Ruth I. Wilson

It is certified that error appears in the above—identified patent and that said Letters Patent is hereby corrected as shown below:

Column 2, line 35, delete "cae" and insert --case--.

Column 5, line 60, delete "srap" and insert --strap--.

Signed and Sealed this

*Twenty-fourth* Day of *May 1983*

[SEAL]

*Attest:*

DONALD J. QUIGG

*Attesting Officer* *Acting Commissioner of Patents and Trademarks*